US008171684B2

(12) United States Patent
Demars et al.

(10) Patent No.: US 8,171,684 B2
(45) Date of Patent: May 8, 2012

(54) GLASS WALL

(75) Inventors: Yves Demars, Clermont (FR); Ivo Smets, Heers (BE); Geurt Roelofsen, Veenendaal (NL); Anne Minne, Etterbeek-brussel (BE)

(73) Assignee: Saint-Gobain Glass France, Courbevoie (FR)

( * ) Notice: Subject to any disclaimer, the term of this patent is extended or adjusted under 35 U.S.C. 154(b) by 172 days.

(21) Appl. No.: 12/097,797

(22) PCT Filed: Dec. 7, 2006

(86) PCT No.: PCT/FR2006/051300

§ 371 (c)(1),
(2), (4) Date: Jun. 17, 2008

(87) PCT Pub. No.: WO2007/077374

PCT Pub. Date: Jul. 12, 2007

(65) Prior Publication Data

US 2009/0000247 A1 Jan. 1, 2009

(30) Foreign Application Priority Data

Dec. 23, 2005 (FR) ..... 05 54079

(51) Int. Cl.
*E04H 1/00* (2006.01)
*E04B 7/00* (2006.01)
*E04C 2/54* (2006.01)

(52) U.S. Cl. ..... 52/235; 52/204.593; 52/204.62; 52/786.1

(58) Field of Classification Search ..... 52/786.1, 52/171.3, 204.593, 204.62, 235, 783.1, 171.1, 52/202, 203; 428/34
See application file for complete search history.

(56) References Cited

U.S. PATENT DOCUMENTS

| | | | | | |
|---|---|---|---|---|---|
| 2,213,468 | A | * | 9/1940 | Haven | 428/34 |
| 2,235,680 | A | * | 3/1941 | Haven et al. | 428/34 |
| 2,618,819 | A | * | 11/1952 | Goodwillie | 428/34 |
| 3,389,737 | A | * | 6/1968 | Arnold et al. | 160/107 |
| 3,919,023 | A | * | 11/1975 | Bowser et al. | 156/107 |
| 3,921,359 | A | * | 11/1975 | Brichard et al. | 52/786.13 |
| 3,968,608 | A | * | 7/1976 | Swango | 52/235 |
| 4,046,951 | A | * | 9/1977 | Stefanik | 428/412 |
| 4,109,431 | A | * | 8/1978 | Mazzoni et al. | 52/172 |
| 4,109,432 | A | * | 8/1978 | Pilz | 52/172 |
| 4,193,236 | A | * | 3/1980 | Mazzoni et al. | 52/172 |
| 4,205,104 | A | * | 5/1980 | Chenel | 428/34 |
| 4,348,435 | A | * | 9/1982 | Mistrick et al. | 428/34 |
| 4,536,998 | A | * | 8/1985 | Matteucci et al. | 52/171.3 |

(Continued)

FOREIGN PATENT DOCUMENTS

DE 102 53 417 5/2004

(Continued)

*Primary Examiner* — Eileen D Lillis
*Assistant Examiner* — Andrew Triggs
(74) *Attorney, Agent, or Firm* — Oblon, Spivak, McClelland, Maier & Neustadt, L.L.P.

(57) ABSTRACT

A glass wall configured to be used as a wall or partition wall includes at least two insulating glazing units. Each glazing unit includes at least two sheets of glass spaced apart by an air gap and assembled by at least one substantially flat insert that is secured by one of its faces to the edge faces of the sheets of glass. The glazing units are secured together by a securing mechanism that collaborates with the inserts placed facing each of the glazing units.

15 Claims, 4 Drawing Sheets

U.S. PATENT DOCUMENTS 4,664,169 A * 5/1987 Osaka et al. ..... 160/107
4,734,295 A * 3/1988 Liu ..... 427/64
4,796,395 A * 1/1989 Israel ..... 52/86
5,122,403 A * 6/1992 Roginski et al. ..... 428/38
5,221,363 A * 6/1993 Gillard ..... 136/248
5,226,466 A * 7/1993 Coddens ..... 160/107
5,245,808 A * 9/1993 Grunewald et al. ..... 52/235
5,381,637 A * 1/1995 Farag ..... 52/204.595
5,637,363 A * 6/1997 Leray et al. ..... 428/34
5,908,704 A * 6/1999 Friedman et al. ..... 428/426
5,996,668 A * 12/1999 DeBlock et al. ..... 160/107
6,311,455 B1 * 11/2001 Gerard ..... 52/786.1
6,736,185 B2 * 5/2004 Smith et al. ..... 160/107
7,021,360 B2 * 4/2006 Schroder et al. ..... 160/168.1 P
7,141,282 B2 * 11/2006 Demars et al. ..... 428/34
7,174,941 B2 * 2/2007 Schroder et al. ..... 160/168.1 P
7,332,202 B2 * 2/2008 Demars et al. ..... 428/34
7,434,790 B1 * 10/2008 Hansen ..... 256/24
2003/0126812 A1 * 7/2003 Folsom et al. ..... 52/204.62
2005/0003116 A1 * 1/2005 Demars et al. ..... 428/34
2005/0271837 A1 * 12/2005 Benardais ..... 428/34
2006/0201084 A1 * 9/2006 Arias ..... 52/235
2007/0003717 A1 * 1/2007 Kawasaki et al. ..... 428/34
2009/0000247 A1 * 1/2009 Demars et al. ..... 52/786.1

FOREIGN PATENT DOCUMENTS

FR 2 662 739 12/1991

* cited by examiner

GLASS WALL

BACKGROUND OF THE INVENTION

I. Field of the Invention

The invention relates to a glass wall used in building, both as an interior partition wall and as an exterior wall of the building.

II. Description of Related Art

Nowadays, walls of buildings, both interior walls and walls connected to the outside of the building are, when made entirely of glass, usually made as monolithic glass glazing units, the glass being joined together by bonding as structural sealant glazing or assembled by other systems as structural glazing. Now, such a wall provides only very mediocre performance in terms of thermal and acoustic insulation.

Hence, the use of insulating multiple glazing units for partition walls in buildings, particularly for dividing offices on the inside, or in the verandas connected to the outside, is an unavoidable necessity if acoustic and/or thermal performance is to be achieved. These glazing units span the full height of the room or alternatively are incorporated into the upper part of the partition wall, the lower part of the wall being made of a solid material other than glass.

A conventional insulating glazing unit has its insert positioned between the sheets of glass over a width of about 15 mm from the edge of the glazing unit.

In order to form a glazed wall, when two glazing units are butted together by means of a mounting and securing strip, it is necessary to provide a width of strip that is enough to, on the one hand, support the glazing units and, on the other hand, hide the inserts. Hence, a total width of about 45 mm is lost in terms of visibility at the connection between two glazing units that form a wall.

It is becoming increasingly desirable to build buildings or to renovate them with interior rooms that have the most natural possible lighting so as to limit the amount of artificial lighting, especially for energy-saving and comfort reasons. A room that has no window but which opens onto a corridor lit by natural light will be more comfortable if a few glazing units that allow light through are incorporated into the partition walls, rather than being walled with solid partitions. Likewise, the current architectural trend towards living quarters that open directly onto the outside is in favor of direct lighting.

BRIEF SUMMARY OF THE INVENTION

However, as explained hereinabove, current partition walls are not entirely satisfactory.

The invention has sought to further optimize the ingress of natural light into the rooms of a building, to obtain maximum visibility, while at the same time providing properties of rigidity, solidity, sealing and maintaining thermal and acoustic properties in the elements forming a partition wall, or an interior or exterior wall of the building.

The invention is characterized by a glass wall intended to be used as a wall or partition wall comprising at least two insulating glazing units, characterized in that each glazing unit comprises at least two sheets of glass spaced apart by an air gap and assembled by means of at least one substantially flat insert which is secured by one of its faces to the edge faces of the sheets of glass, and in that the glazing units are secured together by securing means which collaborate with the inserts placed facing each of the glazing units.

According to the invention, a glass wall is to be understood as meaning a collection of glazing units combined with one another, these glazing units consisting mainly of glass but possibly comprising or being coated with other materials such as plastic. For embodiment details regarding the insulating glazing units that make up the wall according to the invention, reference may in particular be made to patent applications WO 01/79644 and WO 03/040507.

It has actually been found that these new-generation glazing units manufactured with an insert such as this have, as we shall see later, far higher resistance to compression normal to the surface of the glazing units than is achieved in conventional glazing units where the inserts are positioned within the glazing units.

Furthermore, this kind of insert gives the glazing unit a unitary monoblock nature just like monolithic glazing without the risk of one sheet of glass slipping relative to the other when the glazing unit has been mounted, that is to say when it is resting on its edge.

Hence, combining these glazing units forms a glass wall which gives all the mechanical strength and rigidity properties afforded by the current partition walls used in building while at the same time maintaining the advantage of continuous transparency to light over the entirety of its surface area.

According to one feature, the securing means consist of a glued joint. This joint is preferably between 2.5 mm and 5 mm thick.

Advantageously, concealing means are associated with the securing means facing the outside of the wall.

According to an embodiment variant, the securing means consist of a connecting piece fixed by bonding to the inserts.

According to a feature associated with the glazing unit, the insert has a width extending across the width of the glazing unit and bounded by the outer edges of the edge faces of the sheets of glass furthest toward the outside of the glazing unit without overlapping the outer faces of said sheets of glass.

According to another feature, the insert has a linear rigidity of at least 400 N/m. Advantageously, the insert on its external face facing the outside, has a gas-tight and liquid-tight sealing coating of the metallic type.

Beneficially, particularly, for office spaces, at least one glazing unit advantageously incorporates accessories of the slatted blind type inside the air gap.

Preferably, these glazing units comprise functional elements associated with one or more of the sheets of glass, such as surface coatings and plastic films.

Finally, a wall such as this will be used in particular to form an interior partition wall in a room of a building, or an exterior wall of the building. This wall may be fixed or sliding.

BRIEF DESCRIPTION OF THE DRAWINGS

Other features and advantages of the invention will now be described with reference to the drawings in which.

In order to make them easier to understand, the figures are not drawn to scale.

DETAILED DESCRIPTION OF THE INVENTION

Figure 1:
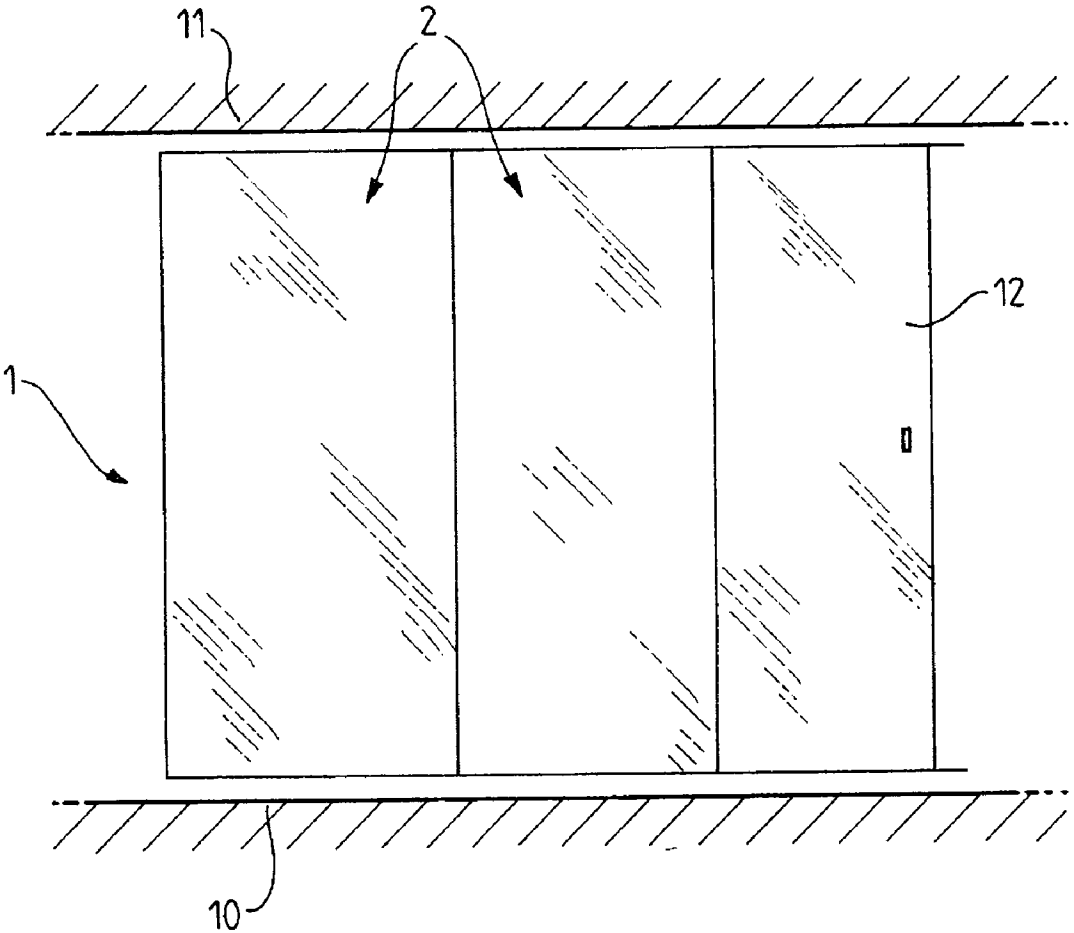
FIG. 1 schematically illustrates a wall of the invention incorporated into a room of a building.

FIG. 1 shows a glass wall 1 constituting an interior partition of a room of a building between a floor 10 and a ceiling 11.

This wall comprises several insulating glazing units 2. The glazing units are butted together widthwise, their height substantially corresponding to that of the room. A door 12 is associated with the wall in order to access the room.

Figure 2:
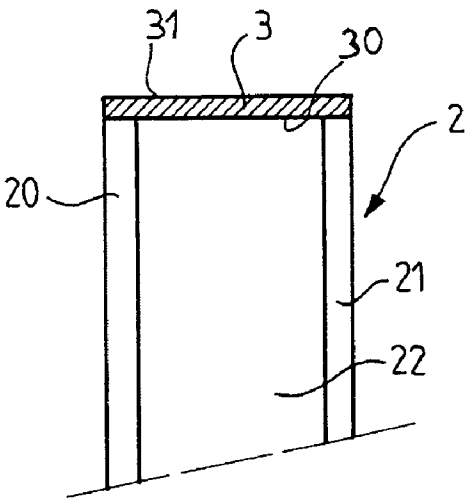
FIG. 2 is a partial view of a glazing unit of the wall.

Each glazing unit 2 is made up, as can be seen in FIG. 2, of at least two sheets of glass 20 and 21 separated by at least one air gap 22 with the aid of at least one flat insert 3 which is positioned on the outside of the sheets of glass. The insert is, via one of its faces 30, secured to the edge faces of the sheets of glass extending across the width of the glazing unit and bounded by the outer edges of the edge faces of the sheets of glass furthest toward the outside of the glazing unit without overlapping the outer faces of said sheets of glass. The glass sheets 20 and 21 may be connected to each other only by the flat insert 3.

This insert consists of at least one or more flat strips butted together, with linear resistance to buckling of at least 400 N/m. The flat strip has a thickness preferably not exceeding 1 to 2 mm. Embodiment details are given in particular in patent application WO 03/040507. An exemplary embodiment of a flat strip is an aluminum tape 0.40 mm thick.

It runs around at least 75% of the periphery of the glazing unit to provide the sheets of glass with mechanical integrity and provide enough rigidity that the behavior of the glazing unit with respect to the external stresses corresponds to that of monolithic glass.

The remainder of the periphery of the glazing unit may comprise an insert of the same flat type or be associated with any other type of known insert customarily positioned between the sheets of glass, sealing being achieved adequately where the flat insert that runs most of the way around the glazing unit and the other insert meet.

In particular, the insert at the upper part 24 of the glazing unit may consist of a conventional or flat insert equipped with accessories towards the inside of the glazing unit, facing the air gap, for example slatted blinds.

This type of glazing unit with a flat insert on the edge face is thus mechanically very strong. It has been demonstrated that, if a conventional glazing unit with a 12 mm air gap for example is compared against a glazing unit with an insert on the edge face, having an air gap of the same 12 mm thickness, if the same force is applied at right angles to the glazing unit, the deflection of the glazing unit with the insert on the edge face was 25% lower than the deflection of the conventional glazing unit.

Finally, the glazing unit may comprise functional elements which, for example, give the wall sun-control or sound-deadening properties, such as surface coatings or plastic films with sound-deadening properties associated with the sheets of glass. The sheets of glass may also be provided with printed decoration, made in enamel or obtained by sand blasting. The glass may be toughened, have fire-retardant properties, etc.

The wall is built by combining at least two glazing units 2 (FIGS. 3*a* to 3*c*) at the flat inserts 3 placed facing each other. The inserts 3 are assembled to one another via their face 31 (the face on the outside of the glazing unit) using securing means 4.

The securing means 4 (FIGS. 3*a* and 3*b*) are, for example, a bonded joint of the cellular foam type with adhesive applied to both sides.

The joint secures the glazing units without giving the wall any additional rigidity. It is about 3 to 4 mm thick so that it also forms a sound-deadening means.

What is more, this thickness is needed to make it easier to remove a glazing unit and therefore to detach it from the adjacent glazing unit without damaging the latter.

The joint 4 is preferably laid over a substantial part of the thickness of the insert 3 rather than across all of the thickness. This is because concealing means 5 are positioned on each side of the joint and facing the outside of the wall so as to conceal this joint for esthetic reasons.

Figure 3C:
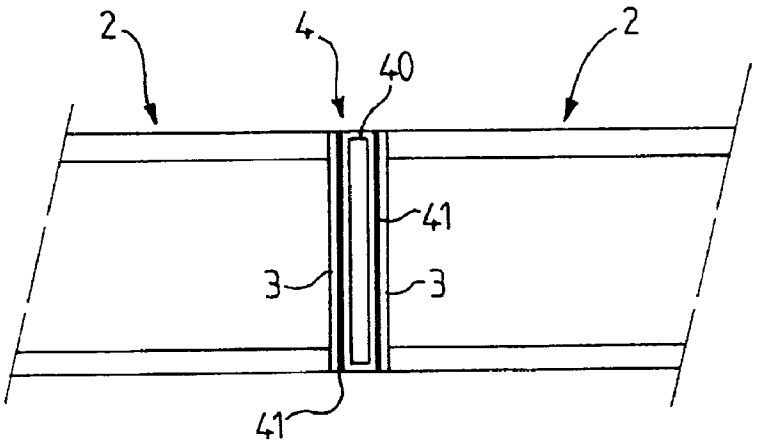
FIGS. 3*a* to 3*c* are views on the line of section A-A' of FIG. 1 for three respective variants of how to secure two glazing units that make up the wall.
Figure 3A:
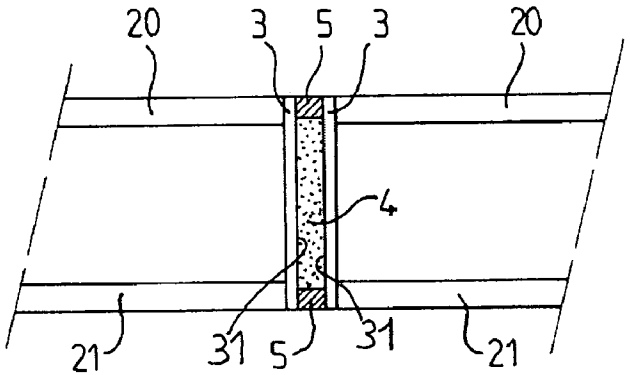
Figure 3B:
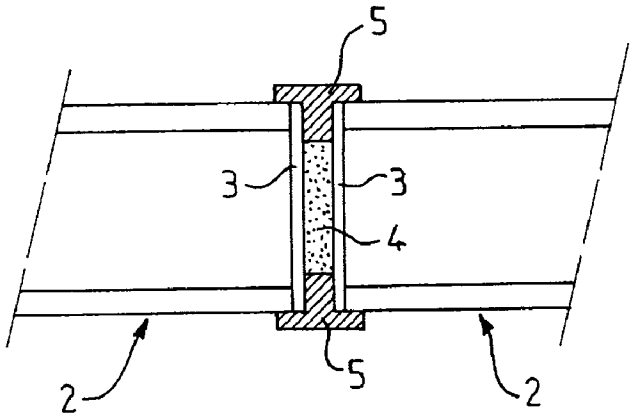

These concealing means consist, for example, of a silicone gasket (FIG. 3*a*) or an attached trim strip (FIG. 3*b*).

FIG. 3*c* illustrates securing means 4 such as a connecting piece 40, for example an aluminum tube, of a width tailored to the thickness of the glazing units. The piece 40 is bonded to the inserts 3 of the glazing units using a bonding compound 41 which is advantageously of the cellular type in order to provide sound deadening.

Each glazing unit 2 is fixed, on the one hand, to the floor 10 and, on the other hand, to the ceiling 11 by means of a base support 6 and a retaining element 7 respectively.

Figure 4C:
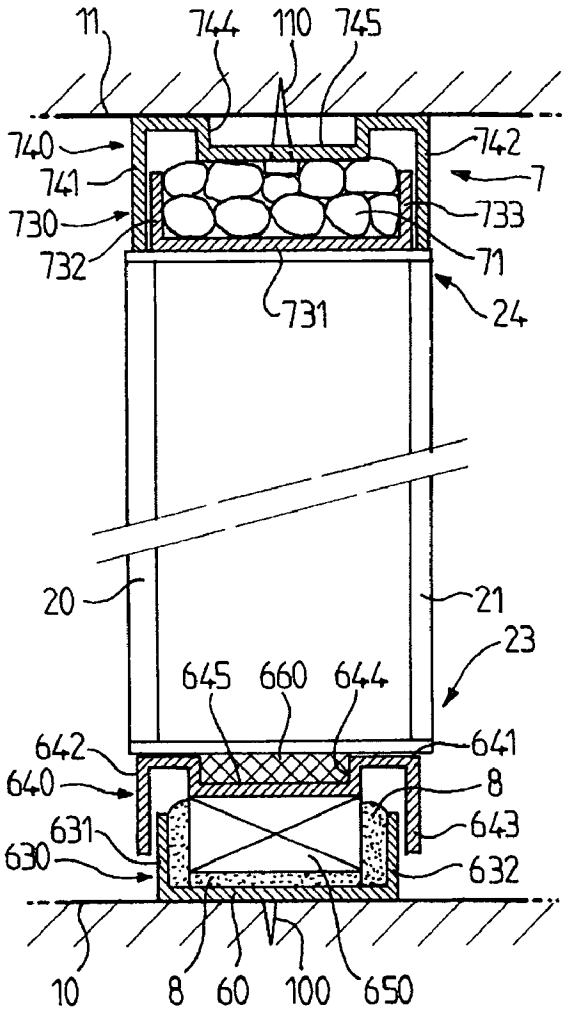
FIGS. 4*a* to 4*c* are views on the line of section B-B' of FIG. 1 for three respective variants of how to fix the wall to the room of the building.
Figure 4B:
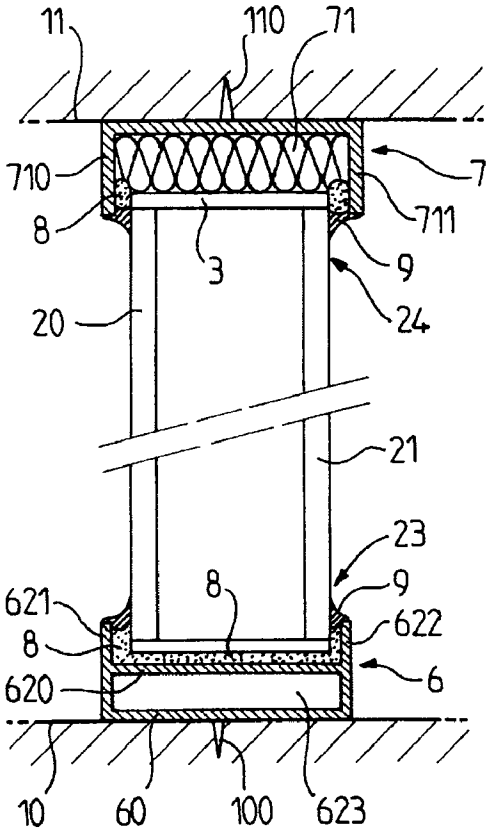
Figure 4A:
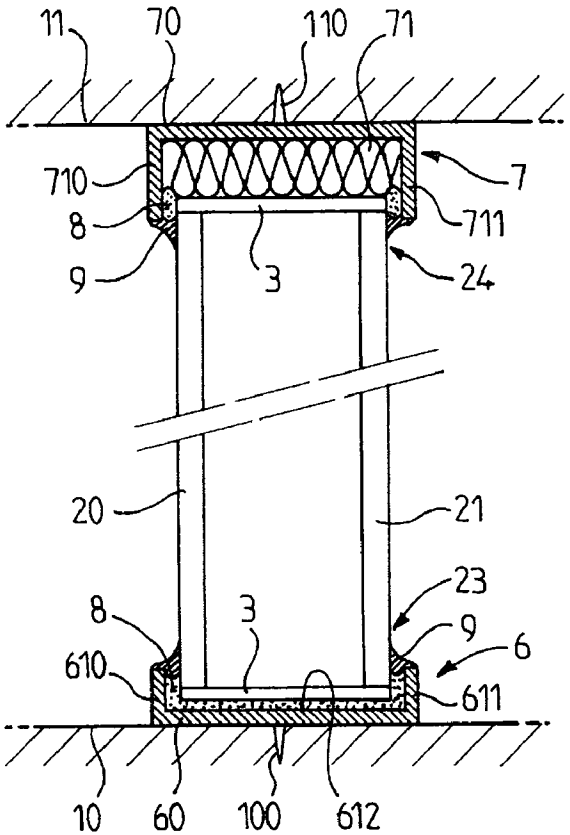

As illustrated in FIGS. 4*a* to 4*c*, the base support 6 and the retaining element 7 have a web 60 and a web 70, respectively, which are fixed respectively to the floor 10 and to the ceiling 11 by any suitable means 100 or 110 respectively, of the screw, rivet, etc., type.

The support 6 may exhibit various forms; it is able to have bearing against it the lower part 23 of the glazing unit which is wedged in place, and it evens out the flatness of the floor if necessary to ensure that the glazing unit lies level.

FIG. 4*a* shows a U-shaped base support 6 comprising two flanges 610 and 611 facing one another and arranged one at each end of the web 60. The flanges may form an integral part of the U-piece or may be clipped on.

The insert 3 along the entirety of the lower side 23 of the glazing unit rests on the interior bottom 612 of the U-shaped support, the flanges 610 and 611 being held against the external faces of the sheets of glass 20 and 21 respectively, in such a way that the lower side of the glazing unit is held enclosed in the U.

Intermediate sound-deadening means 8 of the cellular foam type are advantageously positioned in the U between the glazing unit and the bottom 612 and the flanges 610, 611 of the U.

For esthetic reasons, a strip 9 is attached to the edges of the flanges of the U to hide the foam 8.

Furthermore, provision is made for shims (not illustrated) to be positioned in the bottom 612 of the support before the sound-deadening means 8 are inserted, so as to level the glazing unit if the floor is not entirely level.

FIG. 4*b* shows a base support 6 substantially similar to that of FIG. 4*a* but raised. It also has a parallelepipedal shape, preferably hollow, with its web 60 and an upper part 620 parallel and facing the web on which the lower side 23 of the glazing unit then rests.

Lateral flanges 621 and 622 are positioned at the respective ends of the upper part 620 and facing away from the web 60 to form a U-shaped support, the flanges hugging the external faces of the sheets of glass 20 and 21 of the glazing unit respectively.

Sound-deadening means 8 are provided in the U, between the glazing unit and the part 620 and the flanges 621, 622. Further, a finishing strip 9 is also positioned at the edges of the flanges 621 and 622 and of the means 8.

The base support of this variant advantageously allows the glazing unit to be raised to a height equivalent to plinth height, to prevent the glazing unit from being knocked, for example by floor-cleaning instruments such as a vacuum cleaner.

The hollow parallelepipedal part 623 is, for example, made of an aluminum tube, the recess for example possibly housing electric cables and routing them through the room.

The retaining element 7 in both variants of FIGS. 4*a* and 4*b* respectively is identical. It has a U-shaped cross section comprising a web 70 and two lateral end flanges 710 and 711.

The web 70 is fixed to the ceiling 11 by the means 110, the flanges 710 and 711 facing toward the floor.

A sound-absorbing and substantially compressible material 71 is placed in the bottom of the U.

The upper side 24 of the glazing unit, at the edge faces of the sheets of glass, is intended to be wedged in the retaining element 7, compressed against the absorber 71, and with the flanges of the U hugging the sheets of glass. Intermediate sound-deadening means 8 are advantageously positioned between the sheets of glass and the flanges 710 and 711 at their end. A finishing strip 9 concealing the retaining element from the inside may also be positioned at the edges of the flanges 710 and 711.

In the two embodiment variants described hereinabove, the external faces of the sheets of glass in the lower part 23 and upper part 24 of the glazing unit are covered by the lateral flanges 610, 620 and 611, 621 of the support 6 and 710 and 711 of the retaining element 7, respectively, and this does not give a smooth appearance over the entire height of the glazing unit and therefore of the wall.

FIG. 4*c* proposes another embodiment of the base support 6 and of the retaining element 7 which is such that no surface of these systems used to mount the wall projects with respect to the external faces of the glazing units, so that the wall seems smooth from floor to ceiling.

The base support 6 is thus of a width equivalent to or substantially less than the width of the glazing unit. It comprises two profiled pieces of U-shaped cross section 630 and 640 respectively, which collaborate with one another, the Us facing one another.

The first piece 630 has its web 60 intended to be fixed to the floor 10 and two lateral flanges 631 and 632 respectively. This piece is able to compensate for lack of flatness and evenness of the floor by allowing shims 650 to be inserted inside the U section. Intermediate sound-deadening means 8 are advantageously provided in the bottom of the web 60 and against the walls of the flanges 631 and 632.

The second piece 640 serves to cover the shims 650 and to support the wall. It has a web 641 equipped with a groove 644 and two lateral flanges 642 and 643 respectively.

The two pieces are nested one inside the other in such a way that the U sections face each other; the bottom 645 of the groove in the second piece rests on the shims 650 of the first piece while the flanges 642 and 643 of the second piece sit respectively over the flanges 631 and 632 of the first piece without projecting with respect to the sheets of glass of the glazing unit once mounted.

The groove 644 constitutes a housing accommodating a projecting element 660 attached against the external face of the insert 3 of the lower part 23 of the glazing unit intended to bear on the base support 6, this element 660 having a shape that complements that of the groove so that it can be nested tightly therein.

The external face of the web 641 for its part constitutes a bearing surface for the remainder of the insert 3 of the lower part of the glazing unit.

The retaining element 7 is similar to the base support 6 for reasons of simplifying the number of parts needed to erect the wall. It also has a width equivalent to or substantially less than that of the glazing unit. It comprises two U-section pieces 730 and 740 which collaborate with one another, the two Us facing each other.

The first piece 730 has its web 731 intended to be fixed by bonding against the insert 3 of the upper part 24 of the glazing unit while the web 70 of the second piece is intended to be secured to the ceiling 11 by the means 110 which collaborate with the bottom 744 of the groove 743 formed in the web 70. The flanges 741 and 742 of the second piece cover the flanges 732 and 733 of the first piece respectively.

The inside of the two U sections is filled with a sound-absorbing and substantially compressible material 71.

Figure 5:
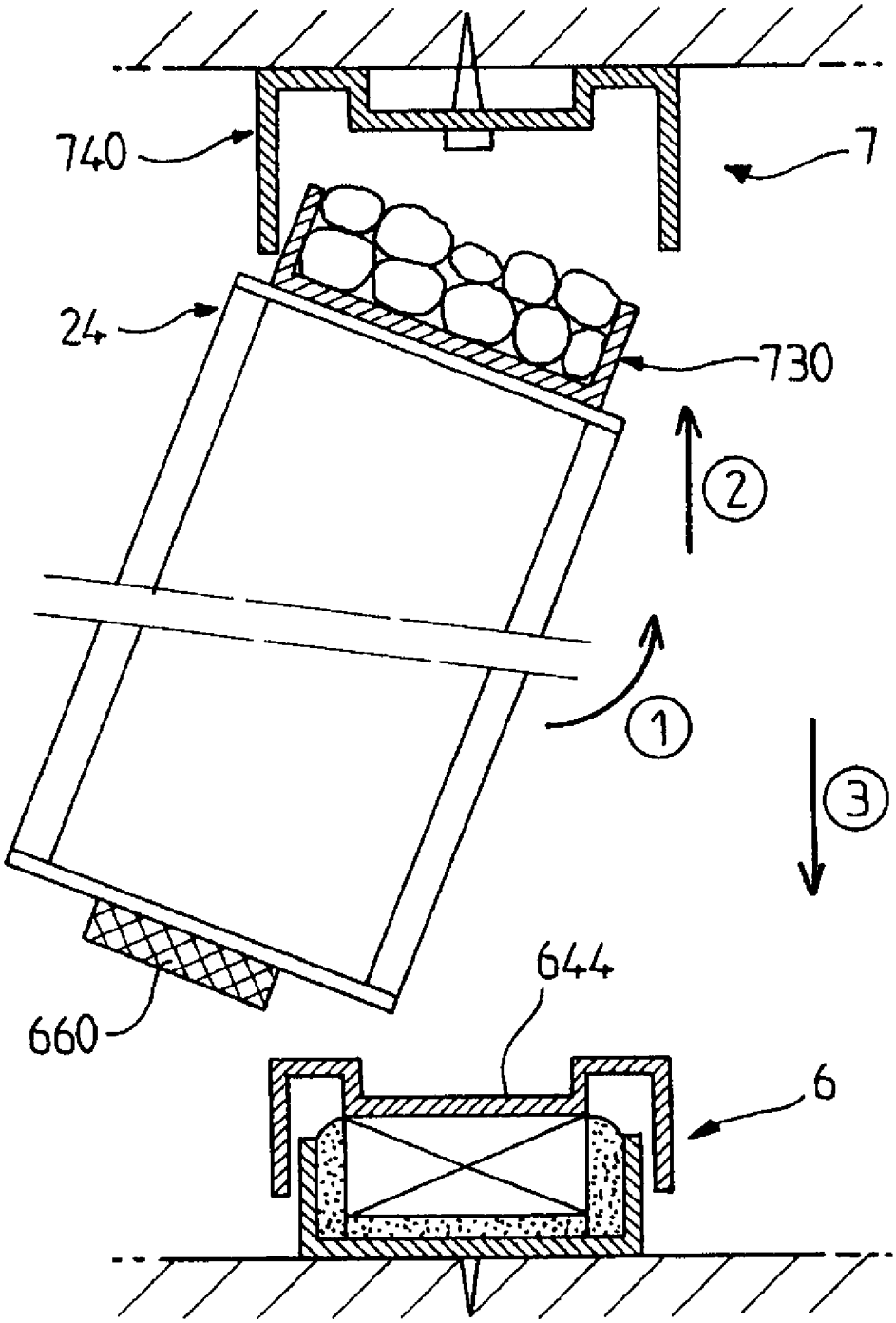
FIG. 5 schematically illustrates the installing of the wall in a sectional view.

Erection of the wall will now be described with reference to FIG. 5 and by means of the fastening systems of the embodiment of FIG. 4*c*.

The length of the base support 6 section pieces and the retaining element 7 are tailored to suit the length of the wall that is to be erected inside the room of the building.

The web of the support 6 is fixed to the floor 10 and, facing it, the web 70 of the retaining element 7 is fixed to the ceiling 11.

Shims 650 are positioned in the first U-piece 630 of the base support 6 up to a suitable height, without, however, exceeding the height of the lateral flanges 631 and 632 of the first piece fixed to the floor, in order to take up any tolerance there might be at floor level so that the wall will be level once erected.

The second piece 640 of the base support 6 is positioned and nested over the first piece 630.

On the glazing unit, the projecting element 660 is fixed against the central part of the insert 3 on the side of the glazing unit intended to be the lower part 23.

The first U-piece 730 of the retaining element 7 is fixed against the central part of the insert 3 on that side of the glazing unit that is intended to be the upper part 24.

The glazing unit can then be engaged at an angle by inserting the piece 730 connected to the upper part 24 of the glazing unit in the second U-piece 740 of the ceiling. By tilting (arrow 1) while lifting the glazing unit towards the ceiling (arrow 2) and then sliding the glazing unit at right angles and floorwards (arrow 3), the projecting element 660 then fits into the groove 644.

If this glazing unit constitutes the glazing unit of one of the ends of the wall, connected to the wall of the room, the insert 3 of the lateral part that is to be in contact with the structural wall will have been provided with securing means 4 beforehand.

The glazing unit thus in place and fixed to the structural wall along one of its sides, is covered with adhesive 4 on its opposite insert 3 on the free lateral part of the glazing unit.

A second glazing unit 2 is set in place in the same way as the first, exerting sideways pressure to secure it to the first glazing unit.

When the partition has been erected, the door 12 may, for example, be associated with the glazing unit at the free end. Various fixing means may be anticipated for the door which may, for example, be mounted on two pivots collaborating one with the floor and one with the ceiling, it being possible for an additional strip to be fixed against the insert of the glazing unit in order to seal against the edge of the door when the door is closed.

This wall may thus be erected in any building, with the outside by, in particular, providing suitable sealing, for example, with reference to FIGS. 4*a* and 4*b*, the strip 9 will be made of a suitable material.

This wall can also be used inside, as described in the exemplary embodiment. It may be fixed, but it may equally be sliding. The wall configuration illustrated in FIG. 4*c* may, in particular, be used, the projecting element 660 collaborating by sliding in a groove of a section piece fixed to the floor.

The invention claimed is:

1. A glass wall to be used as a wall or partition wall, the glass wall comprising:

at least two insulating glazing units, each glazing unit including at least two sheets of glass spaced apart by an air gap, wherein the at least two sheets of glass of each glazing unit are connected to each other only by one substantially flat insert secured by an internal face thereof to all peripheral edges of the sheets of glass, wherein the substantially flat insert has a width extending across the entire width of the glazing unit and bounded by outer edges of the edge faces of the sheets of glass furthest toward the outside of the glazing unit without overlapping outer faces of the sheets of glass, wherein a part of an insert running along an edge of one glazing unit faces a part of an insert running along an edge of an adjacent glazing unit, wherein the at least two insulating glazing units are secured together by securing means that collaborate with the parts of the inserts facing each other, wherein the securing means includes a glued joint, and wherein the glass wall includes concealing means between the at least two insulating glazing units, the concealing means disposed on each longitudinal end side of each glued joint and facing an outside of the glass wall.

2. The wall as claimed in claim 1, wherein the glued joint is between 2.5 mm and 5 mm thick.

3. The wall as claimed in claim 1, wherein the insert has a linear rigidity of at least 400 N/m.

4. The wall as claimed in claim 1, wherein an external face of the insert facing the outside includes a gas-tight and liquid-tight sealing metallic coating.

5. The wall as claimed in claim 1, wherein at least one glazing unit incorporates accessories of slatted blind type inside the air gap.

6. The wall as claimed in claim 1, wherein the glazing units comprise functional elements of surface coating or plastic film type.

7. The wall as claimed in claim 1, wherein the wall is fixed or sliding.

8. A room in a building comprising:

at least one wall as claimed in claim 1 to form an interior partition wall inside the building or an external wall of the building.

9. The wall as claimed in claim 1, wherein the insert is an aluminum tape 0.40 mm thick.

10. The wall as claimed in claim 1, wherein the securing means is disposed between the parts of the inserts facing each other.

11. The wall as claimed in claim 1, wherein the concealing means is bounded by outer edges of the edge faces of the sheets of glass furthest toward the outside of the glazing unit without overlapping outer faces of the sheets of glass.

12. The wall as claimed in claim 1, wherein the concealing means is a silicone gasket.

13. The wall as claimed in claim 1, wherein the securing means has a length greater than a length of the air gap.

14. The wall as claimed in claim 1, wherein the concealing means has a thickness less than a thickness of the sheets of glass.

15. The wall as claimed in claim 1, wherein the securing means is bounded by the inserts and the concealing means such that the securing means is concealed from an outside of the glass wall.

* * * * *